US009538872B2

(12) United States Patent
Kestner et al.

(10) Patent No.: US 9,538,872 B2
(45) Date of Patent: Jan. 10, 2017

(54) PRESSURIZED VISCOUS CONDIMENT DISPENSER

(71) Applicant: Prince Castle, LLC., Carol Stream, IL (US)

(72) Inventors: Kyle Kestner, Schaumburg, IL (US); Anthony Caringella, Norridge, IL (US); Trevor Wesolowski, Chicago, IL (US); Cameron Harder, Chicago, IL (US); Nathan Wicker, Oak Park, IL (US); Aaron B. Eiger, Chicago, IL (US); Mark Kurth, Beverly Shores, IN (US); Timothy Jordan Payne, Chicago, IL (US); Joseph P. Krause, Downers Grove, IL (US)

(73) Assignee: Prince Castle LLC, Carol Stream, IL (US)

( * ) Notice: Subject to any disclaimer, the term of this patent is extended or adjusted under 35 U.S.C. 154(b) by 155 days.

(21) Appl. No.: 14/200,087

(22) Filed: Mar. 7, 2014

(65) Prior Publication Data

US 2015/0251204 A1 Sep. 10, 2015

(51) Int. Cl.

| | |
|---|---|
| ***B65D 35/56*** | (2006.01) |
| ***A47G 19/18*** | (2006.01) |
| *B05B 9/08* | (2006.01) |

(52) U.S. Cl.

CPC ..... *A47G 19/183* (2013.01); *B05B 9/0811* (2013.01); *B05B 9/0838* (2013.01)

(58) Field of Classification Search

CPC .... A47G 19/183; B05B 9/0811; B05B 9/0838
See application file for complete search history.

(56) References Cited

U.S. PATENT DOCUMENTS

| | | | | | |
|---|---|---|---|---|---|
| 2,818,999 | A * | 1/1958 | Miller | B05C 17/015 | 222/323 |
| 3,144,177 | A * | 8/1964 | Cookson | A47G 19/183 | 137/855 |
| 3,270,920 | A * | 9/1966 | Nessler | B05B 7/2472 | 222/136 |
| 3,638,835 | A | 2/1972 | Goodrich et al. | | |
| 4,032,044 | A * | 6/1977 | Flynn | B01F 15/0475 | 222/135 |
| 4,124,147 | A * | 11/1978 | Priese | A47G 19/183 | 222/135 |
| 4,372,354 | A * | 2/1983 | Moore | B67D 7/72 | 141/361 |
| 4,967,933 | A * | 11/1990 | Maiorca | B05C 11/10 | 118/697 |

(Continued)

*Primary Examiner* — Patrick M Buechner
(74) *Attorney, Agent, or Firm* — Andrus Intellectual Property Law, LLP

(57) ABSTRACT

User-selectable volumes of a viscous condiment such as ketchup, mustard and mayonnaise are consistently dispensed from a pressurized vessel. The vessel is pressurized using a small air pump, a cylinder of compressed gas or an external gas source. Pressure in the vessel is kept constant by sensing the pressure using a MEMS pressure transducer. Condiment flows from the pressurized vessel into a flexible tube, which passes through an electrically-actuated pinch valve. For a given pressure in the vessel, the amount of condiment to be dispensed is determined by the time that the pinch valve is open. A processor monitors the pressure, actuation of a user interface and controls operation of the air pump.

24 Claims, 13 Drawing Sheets

(56) References Cited

U.S. PATENT DOCUMENTS 5,158,210 A * 10/1992 Du ..... B67D 1/102 222/134
5,323,931 A * 6/1994 Robards, Jr. ..... B05C 17/00583 222/105
5,339,995 A 8/1994 Brown et al.
5,366,117 A * 11/1994 Mesenbring ..... B67D 1/103 222/132
5,421,485 A 6/1995 Furuta et al.
5,435,466 A * 7/1995 Du ..... B67D 1/103 222/108
5,443,181 A 8/1995 Popp et al.
5,542,574 A * 8/1996 Stern ..... B67D 1/103 222/137
5,568,882 A * 10/1996 Takacs ..... G01F 23/168 222/155
5,624,056 A * 4/1997 Martindale ..... B67C 3/2608 222/148
5,634,572 A 6/1997 Lane et al.
5,823,388 A * 10/1998 Green ..... B67D 1/0054 222/1
5,996,846 A * 12/1999 Martindale ..... B67C 3/2608 222/132
6,079,594 A 6/2000 Brown et al.
6,082,587 A * 7/2000 Martindale ..... B67C 3/2608 222/108
6,189,736 B1 * 2/2001 Phallen ..... F04B 13/02 222/105
6,193,111 B1 * 2/2001 Adams ..... B67D 7/64 222/148
6,390,662 B1 * 5/2002 Henry ..... A21C 15/005 118/14
6,406,763 B1 6/2002 Wolf et al.
6,520,380 B1 * 2/2003 Veltrop ..... G01F 11/025 222/135
6,598,764 B1 7/2003 Stern
6,685,691 B1 2/2004 Freund et al.
7,140,514 B2 * 11/2006 Van Der Klaauw . B67D 1/0412 222/129.1
2003/0197023 A1 * 10/2003 Chuen ..... A47G 19/183 222/109
2004/0112915 A1 6/2004 Franczyk
2006/0138167 A1 * 6/2006 McMahon ..... A47G 19/183 222/100
2007/0029343 A1 * 2/2007 Sanfilippo ..... A47G 19/183 222/102
2008/0142545 A1 6/2008 Priolo et al.
2009/0272767 A1 11/2009 Herman et al.
2011/0006076 A1 1/2011 Williams
2012/0065608 A1 3/2012 Costello et al.
2012/0067920 A1 * 3/2012 Veltrop ..... B67D 3/0019 222/1
2012/0267396 A1 * 10/2012 Quinlan, Jr. ..... A47K 5/14 222/190
2012/0326061 A1 * 12/2012 Veltrop ..... F16K 7/06 251/7
2015/0102057 A1 * 4/2015 Gehl ..... A47G 19/183 222/81
2015/0298148 A1 * 10/2015 Barron ..... A47G 19/183 222/103

* cited by examiner

PRESSURIZED VISCOUS CONDIMENT DISPENSER

BACKGROUND

Portion control and finished product consistency are important to fast food restaurants, especially national restaurant chains, whose trademarks tend to connote product consistency. Portion control and product consistency are also important to the food service industry in general as a way to control costs.

Most establishments that prepare or serve sandwiches with condiments such as ketchup, mustard, relish and mayonnaise, often prefer to make and/or serve them with the same amount of condiment on each sandwich, regardless of when or where the product was produced and/or by whom. A hand-held device that can consistently and reliably dispense different user-selectable amounts of condiment with each and every use, would be an improvement over the prior art. A dispenser that can also be easily disassembled for maintenance would also be an improvement over the prior art.

DETAILED DESCRIPTION

Figure 1B:
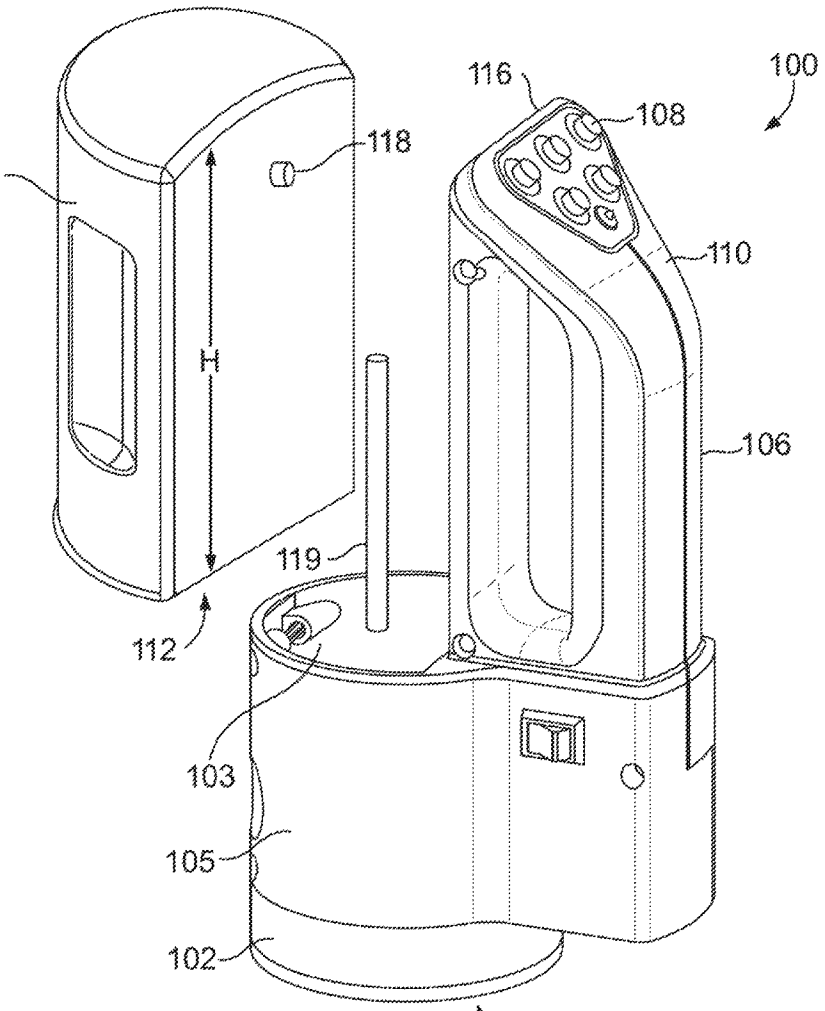
FIG. 1B is a right-side perspective view of the dispenser shown in FIG. 1A and showing how a replaceable, condiment-holding pressurizable vessel is loaded into the dispenser.
Figure 1A:
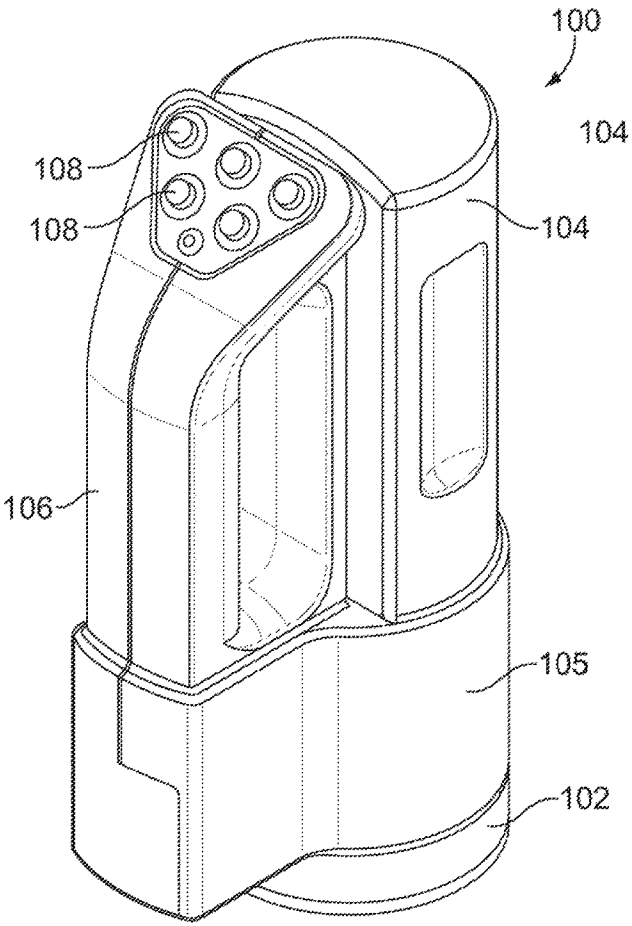
FIG. 1A is a right-side perspective view of a pressurized viscous dispenser for condiments.

FIG. 1A is a perspective view of a pressurized viscous condiment dispenser 100. The dispenser 100 is hand-held, portable and powered by a rechargeable battery, not visible in FIG. 1A.

Figure 1C:
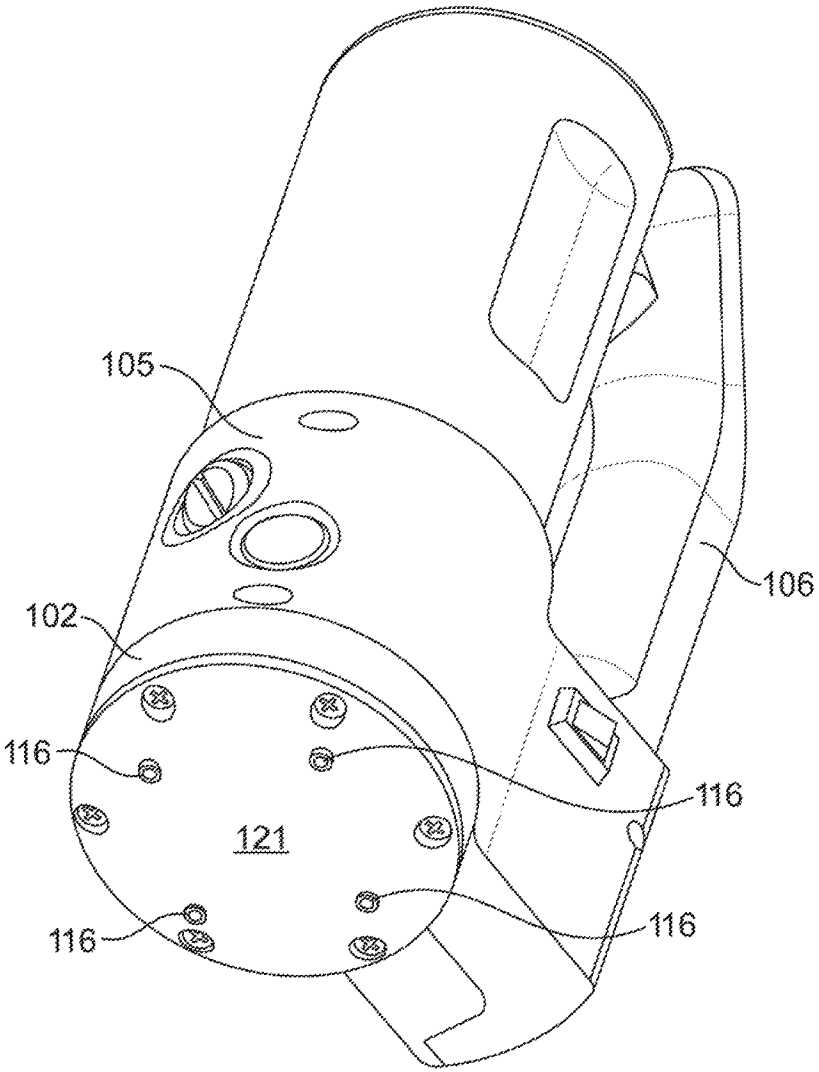
FIG. 1C is a bottom view of the dispenser, showing viscous condiment dispensing nozzles.

The dispenser 100 comprises a plastic housing 105 with a substantially circular plastic base 102 above which is a removable plastic vessel 104 configured to be pressurized by an air pump, not visible in FIG. 1. FIG. 1B, which is a left-side view, shows how the vessel 104 is removed from and replaced onto the housing 105.

Referring now to both FIGS. 1A and 1B, a plastic handle 106 that extends upwardly from the base 102 is sized, shaped and arranged to allow a person's hand to grasp the handle and thereby move the dispenser 100 about. Viscous condiment in the vessel 104 is dispensed by actuating one or more push buttons 108 located at the top 110 of the handle 106.

As described below, the push buttons 108 are electrically connected to a processor. Their actuations send signals to the processor that cause the processor to open a condiment dispensing valve. The length of time that the valve is open determines the amount of condiment that is dispensed. The push buttons 108 thus comprise a user interface by which the amount of condiment dispensed can be controlled by a user's actuation of one or more of the push buttons 108.

In the embodiment shown in FIG. 1B, a viscous condiment such as ketchup, and which is to be dispensed, is loaded into the vessel 104 through the open "bottom" 112 of the vessel 104. The vessel 104 or the dispenser 100 are then inverted to enable the bottom 112 of the vessel 104 to be mated and fitted into a crescent-shaped opening 103 in the base 102. The handle 106 is sized, shaped and arranged and the height, H, of the vessel selected such that the top 114 of the vessel 104 is snapped under the top end 116 of the plastic handle 106. The handle 106 thus keeps the vessel 104 "locked" down as pressure inside the vessel is increased.

In one embodiment, a nozzle 118 on the side of the vessel 104 is sized, shaped and arranged to receive an air hose fitting, not visible in FIG. 1A or 1B, through which air is pumped into the vessel 104 in order to pressurize the vessel 104. In another embodiment, air is introduced into the vessel through a pipe 119, reminiscent of a snorkel, which is coupled to an air pump in the base 102.

Viscous condiment in the vessel 104 flows from the open bottom 112 of the vessel 104 into a plastic funnel in the base 102. The neck of the funnel leads to a flexible discharge hose, not visible in FIG. 1A or 1B. The pressurized condiment is dispensed by opening an electrically-powered and therefore electrically-actuated pinch valve coupled to the hose, not visible in FIG. 1. When the pinch valve is opened by the application of an electrical signal thereto, pressurized condiment from the vessel 104 flows through the hose to dispensing nozzles 116 located in the bottom 121 of the base 102, best seen in FIG. 1C. The number, spacing and arrangement of the nozzles 116 in the bottom 121 of the base 102 can be arranged in various patterns to effectuate different distributions of condiment onto a sandwich.

Figure 2:
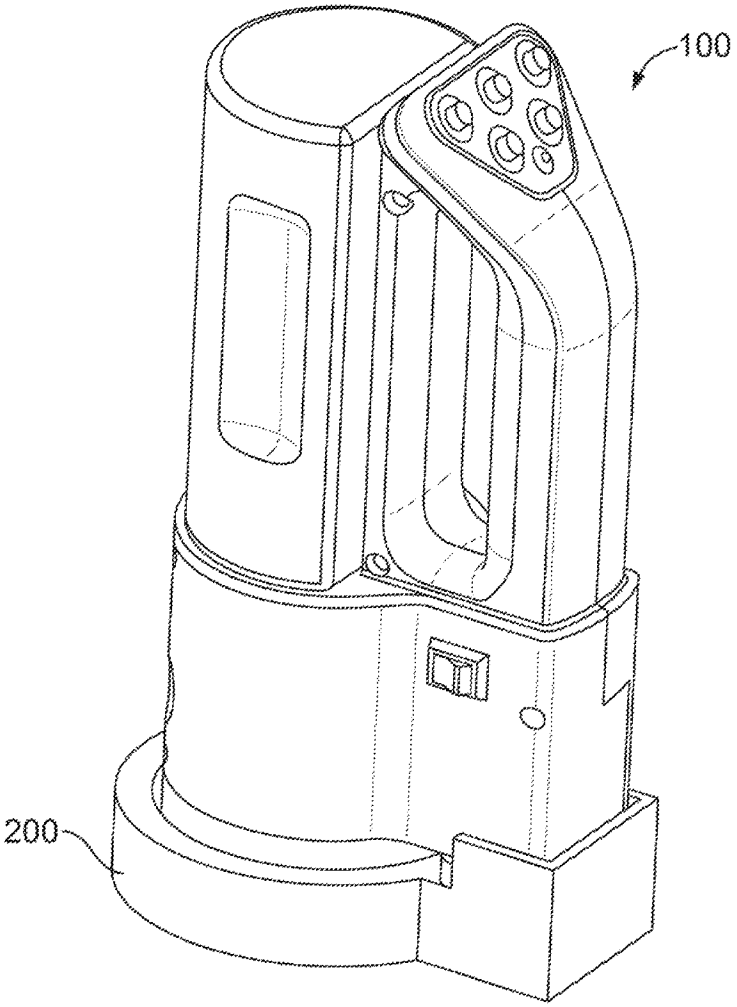
FIG. 2 is a left-side perspective view of the dispenser, seated in an inductive charging station.

FIG. 2 is a left side perspective view of the dispenser 100 showing the dispenser 100 mounted in base station 200, which holds the dispenser upright when it is not in use.

Figure 3:
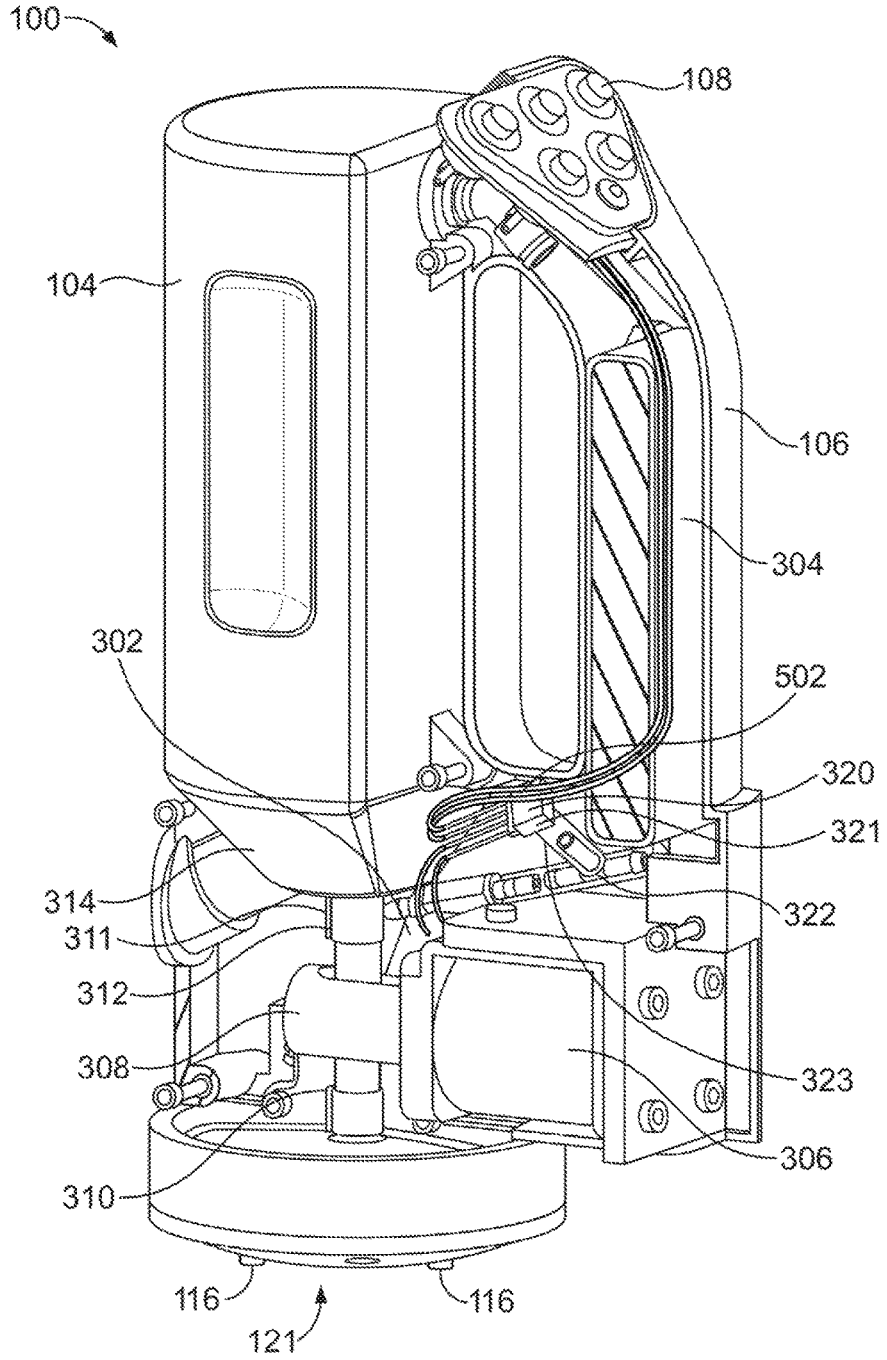
FIG. 3 is a partial cut-away of the left-side of the dispenser.

FIG. 3 is a partial cut-away view of the dispenser 100 showing the pressurized vessel 104. FIG. 3 shows the buttons on the handle 106 and which comprise user interface 108. It also shows a partial view of an air compressor 302, a rechargeable battery 304 located inside the handle, which powers the dispenser 100, a solenoid 306, which actuates a pinch valve 308 through which extends a flexible plastic hose 310 having a first or top end 311 attached to the neck 312 portion of a funnel 314 into which the pressurized condiment flows from the vessel 104.

The pinch valve 308 controls the flow of viscous condiment through a flexible tube 310 which extends through the pinch valve 308 from the neck 312 of the funnel 314. Since the condiment is under pressure, it flows through the tube 310 to an array of dispensing nozzles 116 located at the bottom 121 of the base 102.

Figure 4:
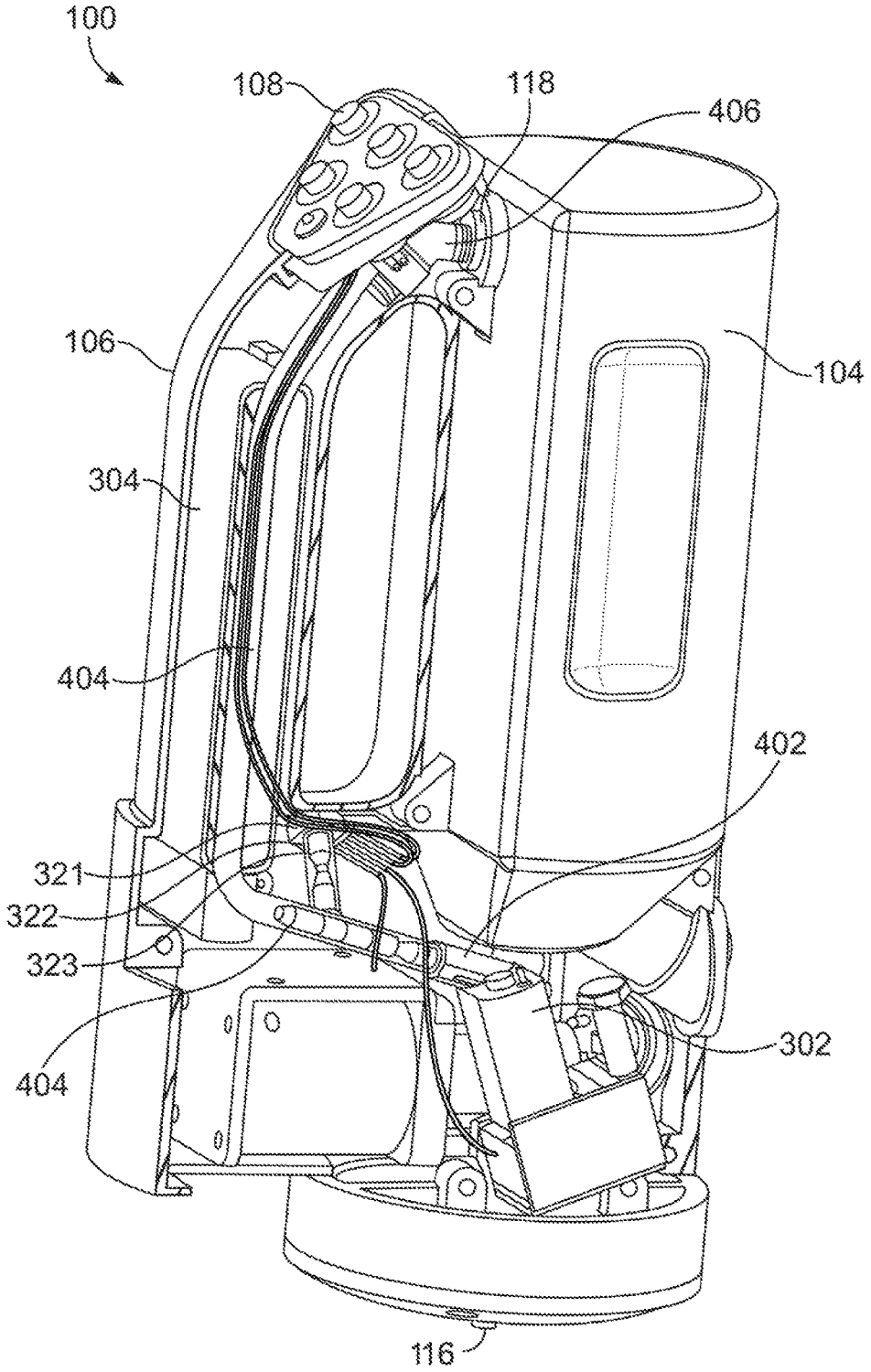
FIG. 4 is another partial cut-away view of the right side of the dispenser.

FIG. 4 is a right side partial cut-away view of the dispenser 100. An air pump 302, preferably a miniature diaphragm air pump available from Parker Hannifin Corporation of Hollis, N.H., has an air discharge nozzle or opening 402, attached to which is a flexible hose 404. The hose 404 extends from the discharge opening 402 upwardly through the handle 106. The hose 404 runs under the user interface 108 to a forty-five degree elbow fitting 406, which couples the hose 404 to the nozzle 118 that extends outwardly from the side of the vessel 104.

The pump 302 is electrically operated. It runs responsive to signals it receives from a processor 320, which is preferably co-located in a housing 321 having a pressure transducer 323. The housing 321 that encloses the processor 320 and transducer 323 is best seen in FIG. 3.

When the pump 302 is turned on, air flows through the hose 404 and into the vessel 104. As the volume of air forced into the vessel 104 by the pump 302 increases, the pressure inside the vessel 104 increases. Pressurized air introduced into the vessel 104 by the pump will thus force viscous condiment out the bottom 112 of the vessel 104 and through the flexible tube 310 responsive to actuation of the valve 308, which is preferably a pinch valve.

Still referring to FIG. 3, pressure inside the vessel 104 is controlled using a pressure transducer or pressure sensor 320 coupled to the hose 404. In a preferred embodiment, the pressure transducer 320 is preferably embodied as a MEMS pressure transducer, which are well known in the art. See for example U.S. Pat. No. 7,997,142 entitled, "Low Pressure Sensor Device with High Accuracy and High Sensitivity," the contents of which are incorporated herein in their entirety.

Figure 8:
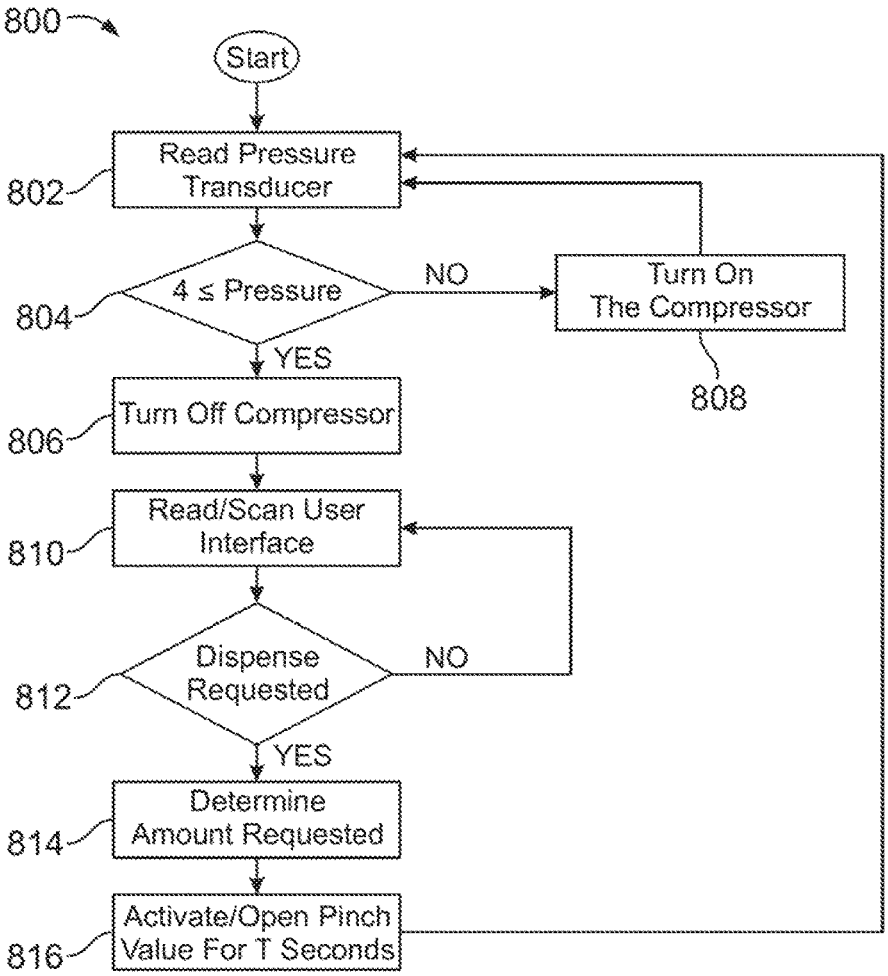
FIG. 8 is a flow chart depicting steps of a method for dispensing condiment from a pressurized vessel.

The pressure transducer 320 is connected into the hose 404 by a conventional T-fitting 322. It provides an electrical output signal that represents the pressure on the hose 404 responsive to actuation of the air compressor 302. The output signal from the MEMS pressure transducer 320 is provided to a processor shown in FIG. 8 and described more fully below. The processor, which as shown in FIG. 8 is coupled to the user interface, air pump, pinch valve and pressure transducer, starts and stops the air pump responsive to pressure on the hose, which is essentially the same as the pressure in the vessel 104.

Figure 5:
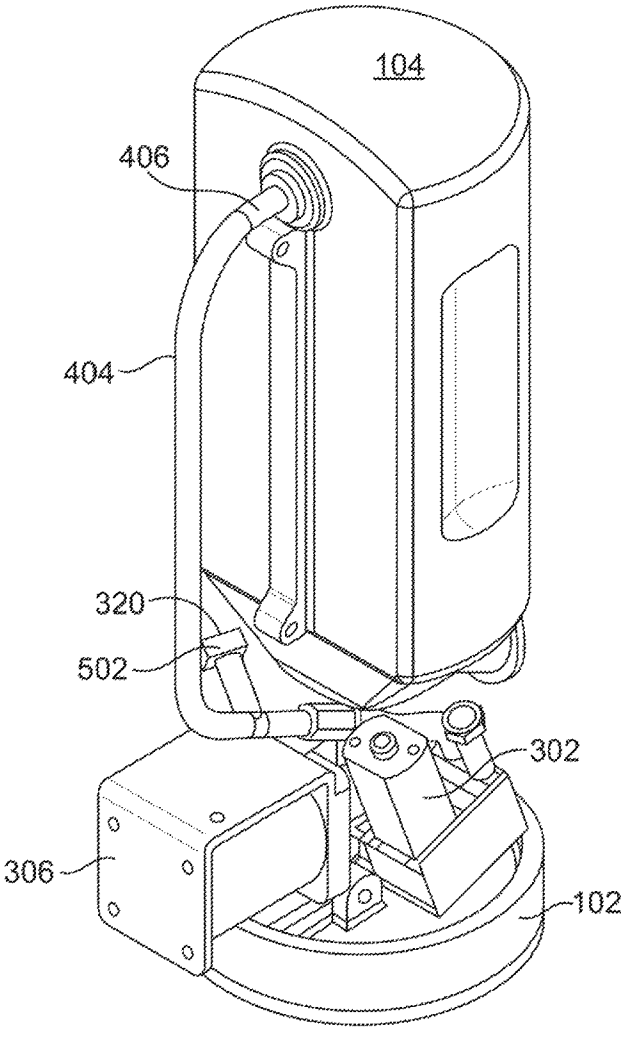
FIG. 5 is a perspective view from the right side of the dispenser with the handle removed, showing an air pump and routing for an air pressure hose.

FIG. 5 is an isometric view of the dispenser 100 without the handle 106, the user interface 108 and the housing 105, which wraps around and encloses the air pump 302, solenoid 306, pinch valve 308, the tubing 404 and a processor 502, preferably embodied as a microcontroller co-located in the same housing as the pressure transducer 320. The processor 502 is coupled to and controls the electrical components of the dispenser 100.

Figure 6:
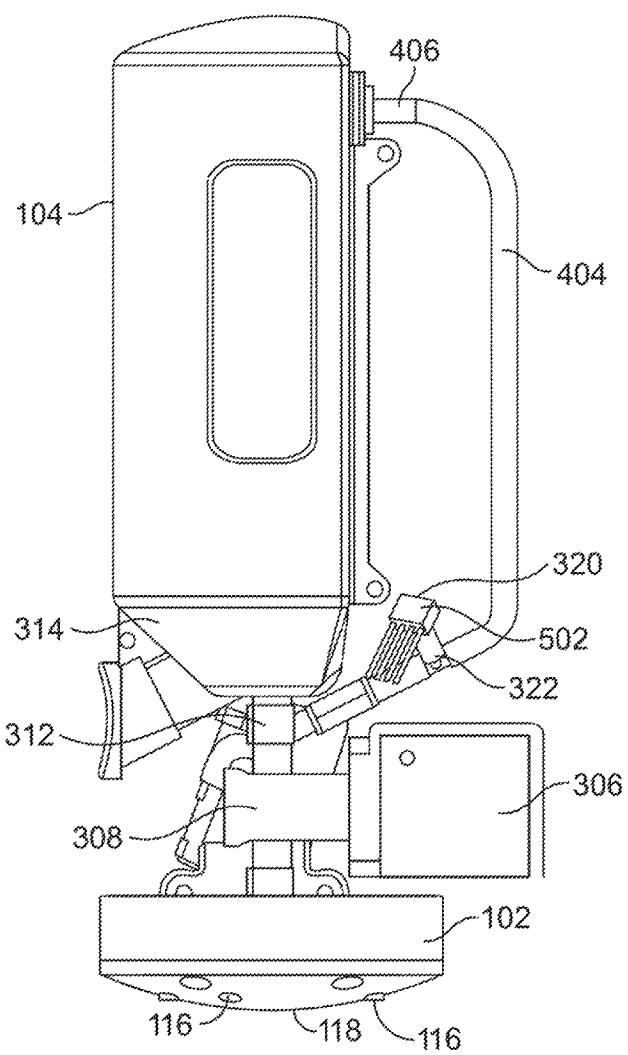
FIG. 6 left-side elevation of the dispenser.

FIG. 6 is a right side sectional view showing the dispenser 100 without the handle 106 and without the housing 105. The pressure transducer 320, which is coupled into the air hose 402 by a plastic T fitting 322 includes therein, a semiconductor die that contains a processor 502 embodied as a microcontroller, which are devices well known to those of ordinary skill in the electronic art.

The processor 502 performs several functions. It reads or detects electrical signals from the user interface 108 and reads signals from the pressure transducer 320. In addition to reading signals from the user interface 108 and pressure transducer 320, the processor 502 controls actuation of the pinch valve by sending electrical signals to the solenoid 306 and controls actuation of the air pump 302 by sending electrical signals to the pump.

Figure 7:
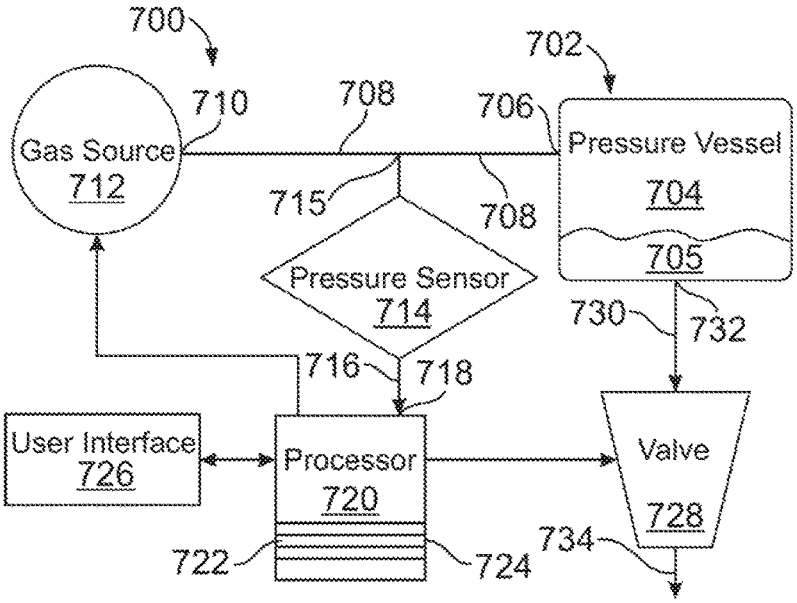
FIG. 7 is a functional block diagram.

FIG. 7 is a block diagram of components comprising a pressurized viscous condiment dispenser 700. In FIG. 7, a vessel 704 capable of being pressurized up to about fifteen (15) pounds per square inch (PSI), has an opening 702 through which condiment 705 can be added to the vessel 704.

A gas pressure inlet 706 to the vessel 704 is coupled to a flexible plastic air hose 708, which extends to an output port 710 of a gas source, preferably embodied as a small electrically-powered air compressor 712.

A pressure transducer 714, preferably embodied as a MEMS pressure transducer, is pneumatically coupled to the hose 708 through a conventional T-fitting 715. The pressure transducer generates an output voltage 716 that is proportional to the pressure in the hose 708. The output voltage 716 is provided to an analog input port 718 of a processor 720.

The processor 720 is preferably embodied as a microcontroller. It executes program instructions 722 stored in a non-transitory memory device 724, one example of which is an electrically-erasable programmable read only memory or EPROM, coupled to the processor 724.

As shown in the figure, the processor 720 is electrically coupled to the pressure transducer 714 as well as the air compressor 712, a user interface 726, preferably embodied as multiple switches, and a pinch valve 728. When the program instructions 722 are executed by the processor 720, they cause the processor 720 to perform several operations. Those operations are depicted in FIG. 8, which is a flow chart illustrating steps of at least one method 800 by which a viscous condiment is dispensed.

At a first step 802, the processor 720 reads the signals output from the pressure transducer 714 to determine whether there is any pressure on the hose 708. At step 804, a determination is made whether the pressure on the hose 708 is between about four PSI and about eight PSI but preferably at least six PSI. If the pressure on the hose is at least four PSI, the processor 720 turns off the air compressor 712 at step 806. If the pressure on the hose 708 is below about four PSI, the processor 720 turns on the compressor 712 at step 808 and continues to run the compressor until the hose pressure reaches a pressure between about four and six PSI.

If the hose 708 is pressurized, the vessel 704 is assumed to be pressurized. The method 800 proceeds to step 810, where the processor 720 scans or queries the user interface 718 at step 812 for a signal indicating that a viscous condiment should be dispensed. If a dispense signal is received from the user interface 718 at step 812, the processor 720 determines how much condiment was requested at step 814. When the requested amount is known, the method 800 proceeds to step 816 where the pinch valve 728 is opened at step 816 by sending a signal to the pinch valve 728 that causes it to retract and thus allow pressurized, viscous condiment to flow through a flexible tube 730 extending from a discharge port 732 of the vessel 704.

Those of ordinary skill in the art will recognize that the amount of viscous condiment dispensed from discharge end 734 of the flexible tube 730 will be determined by several factors. Those factors include the pressure on the vessel 704, the time that the pinch valve 728 is open, the inside diameter of the tube 730 and the viscosity of the condiment in the vessel 704.

If the pressure in the vessel is kept substantially constant, using for example the devices described above, the volume of condiment that is dispensed will be proportional to the time that the pinch valve is open. Stated another way, the application of a substantially constant pressure to a viscous condiment inside the vessel 104 enables a consistent dispensing of viscous condiment according to the valve open time, regardless of the level of the condiment inside the vessel 104.

Figure 9:
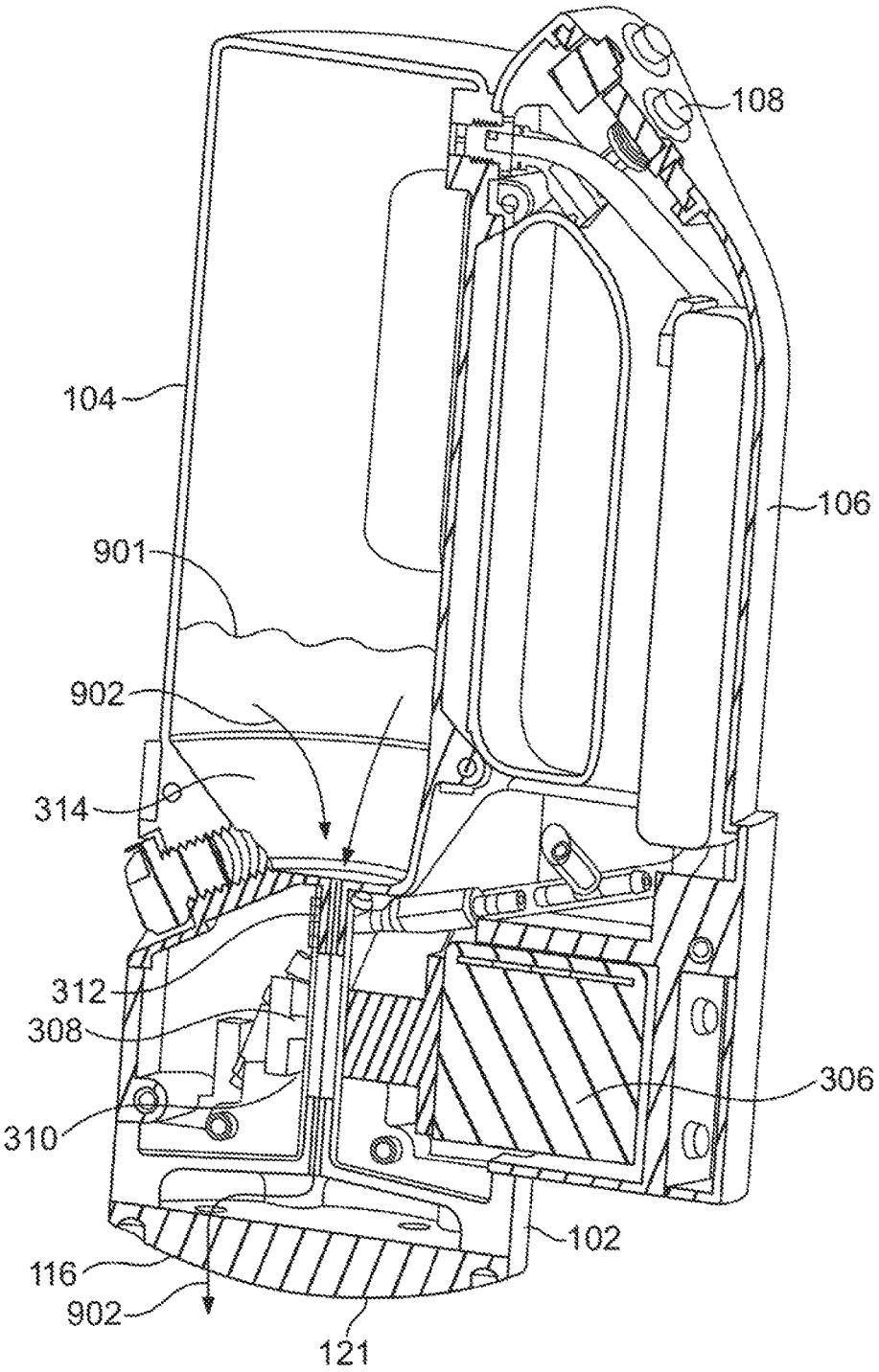
FIG. 9 is a cross sectional view of the dispenser.

FIG. 9 is a cross sectional view of the pressurized viscous condiment dispenser 100. The arrows identified by reference numeral "902" show viscous condiment 901 inside the vessel 104 flowing downwardly, through the flexible hose 310 that passes through the pinch valve 308. After the viscous condiment 901 flows past the pinch valve 308, it is discharged through nozzles 116 formed into the bottom 108 of the base 102.

By using a relatively fixed or constant pressure applied to a viscous condiment, the amount of condiment dispensed can be controlled simply by controlling the time, t, that the valve 728 is kept open at step 816. By way of example, if opening the valve for one second dispenses two cubic centimeters and opening the valve for two seconds dispenses four cubic centimeters, opening the valve for three seconds will dispense six cubic centimeters and so on. A constant pressure applied to the condiment thus ensures a relatively constant flow rate of condiment and a consistent dispensing of condiment.

In a preferred embodiment the valve 728 is a pinch valve. In alternate embodiments, however, gate valves, ball valves and shuttle valves can also be used.

In a first embodiment the condiment to be dispensed is provided into the vessel 704 from a bulk container. In a second embodiment the pressurized vessel 704 is configured to receive a bag, sized, shaped and arranged to be fit within the vessel 704 and which is pre-filled with a viscous condiment to be dispensed. An example of a bag is disclosed in the Applicant's co-pending application Ser. No. 13/413,608, filed Mar. 6, 2012, published as pre-grant publication number 2013/0233886 and which is entitled, "Dispenser for Viscous Food Products." The contents of co-pending patent application Ser. No. 13/413,608, is incorporated herein by reference in its entirety.

Figure 13:
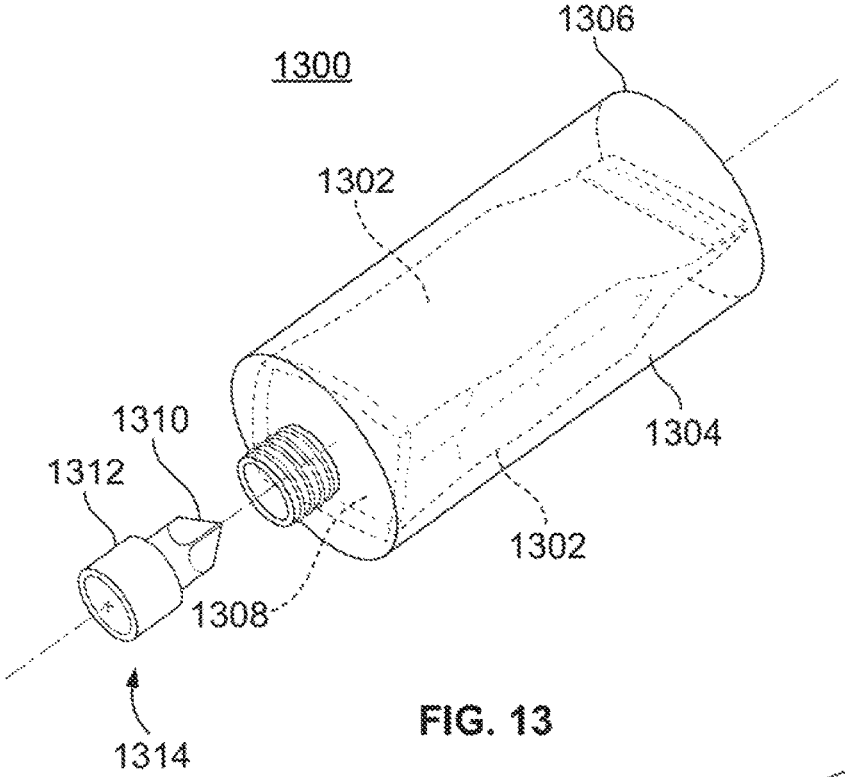
FIG. 13 depicts the use of a flexible plastic bag, pre-filled with a viscous condiment, placed inside a tube that can be pressurized.
Figure 14:
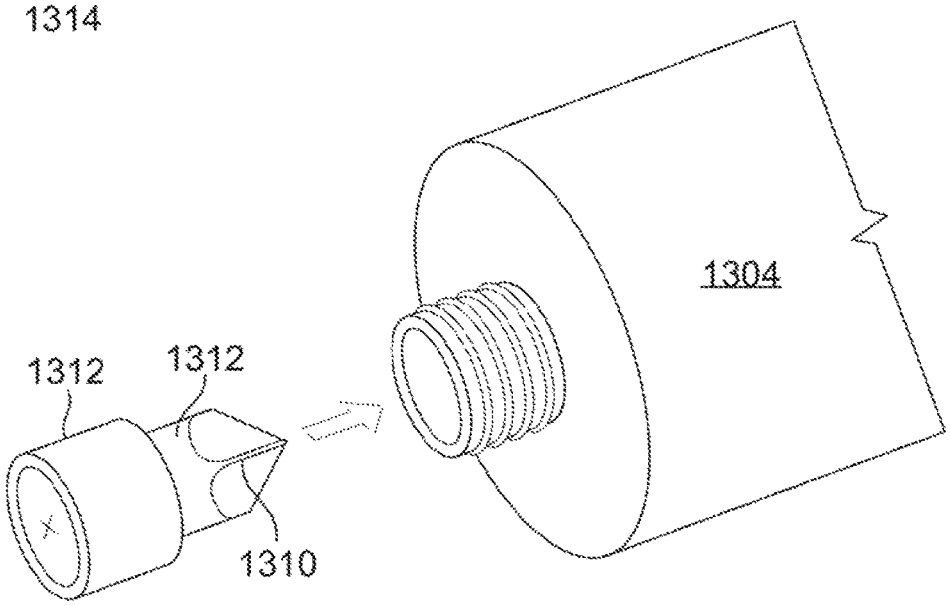
FIG. 14 depicts a structure by which the bag in the tube shown in FIG. 13 can be pierced and coupled to a flexible tube through which condiment can be made to flow.

Referring now to FIGS. 13 and 14, which are copies of FIGS. 7 and 8 from patent application Ser. No. 13/413,608, a flexible plastic bag 1302, pre-filled with a viscous condiment, is fitted into a plastic tube 1304 through an open end 1306 of the tube 1304. The tube 1304 is constructed so that it can be pressurized. A substantially flat, closed "bottom" 1308 of the bag 1302 is pierced by a four-blade knife 1310 at the distal end of a hollow dispensing tube 1312 formed from rigid plastic as part of a threaded discharge cap 1314. The hose 730 that extends through the pinch valve 728 is extended upwardly to the discharge cap 1314 and is fit over the cap 1314.

Figure 15:
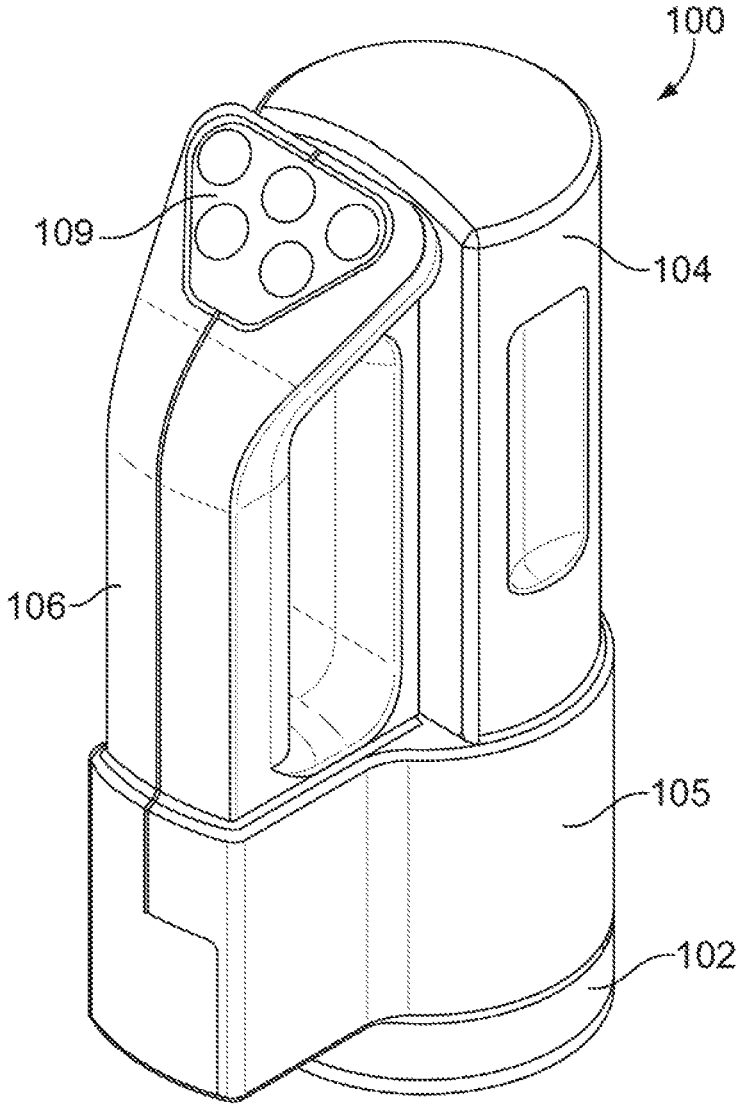
FIG. 15 depicts a still further embodiment of a dispenser with a touch screen user interface.

In a preferred embodiment the user interface 726 comprises multiple push button switches. The actuation of different switches comprising the user interface 726 causes the pinch valve 728 to be held open for different lengths of time. In an alternate embodiment, the user interface can be a touch sensitive screen 109, such as the screen used on so-called smartphones as exemplarily depicted in FIG. 15.

Figure 10A:
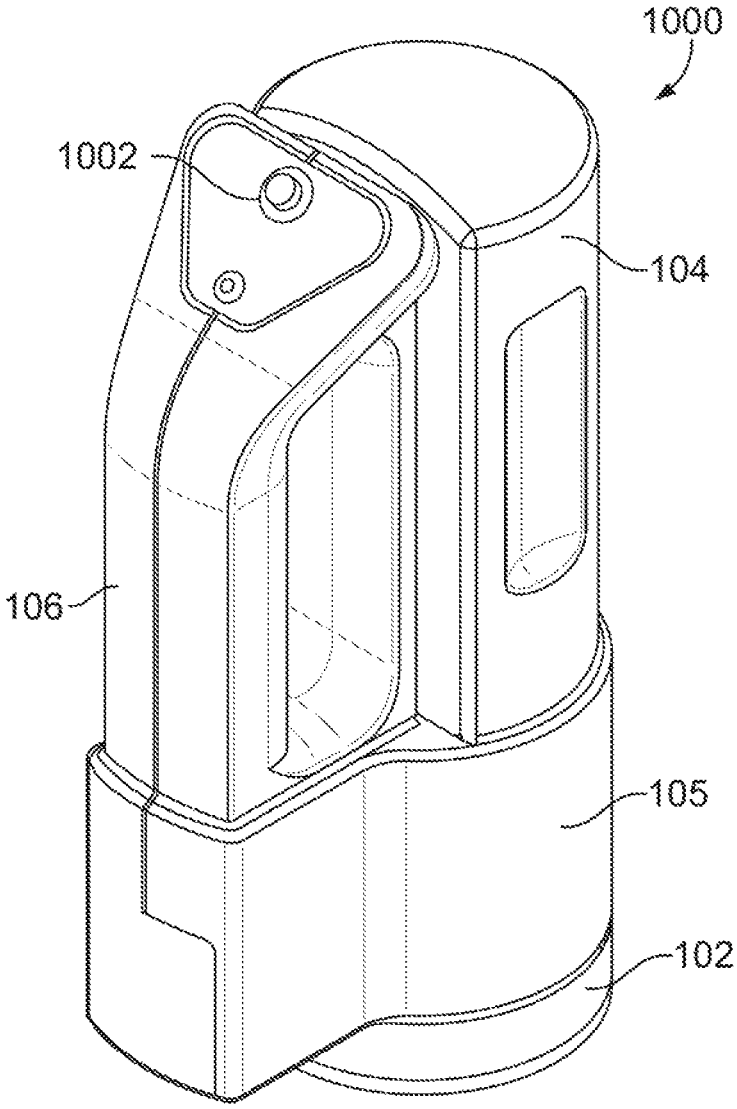
FIG. 10A is a perspective view of an alternate embodiment of a pressurized viscous condiment dispenser.

FIG. 10A is a perspective view of an alternate embodiment of a pressurized viscous condiment dispenser 1000. The dispenser 1000 shown in FIG. 10A has most of the components of the embodiment shown in FIG. 1A. Instead of having a user interface comprising multiple push button switches, the actuations of which cause different amounts of condiment to be dispensed, the dispenser 1000 shown in FIG. 10A has a single push button switch 1002. Actuation of the one switch 1002 shown in FIG. 10A causes the aforementioned pinch valve 728 to be held open for a single, predetermined length of time. It can also be held open continuously if the single push button switch 1002 is held in a closed position.

The single opening actuation is effectuated using appropriate program instructions in the processor. In an alternate embodiment, a "one-shot" timer, well known to those of ordinary skill in the electronic art, is used to control the opening of the valve for a time period that is determined by components of the one-shot timer.

Figure 10B:
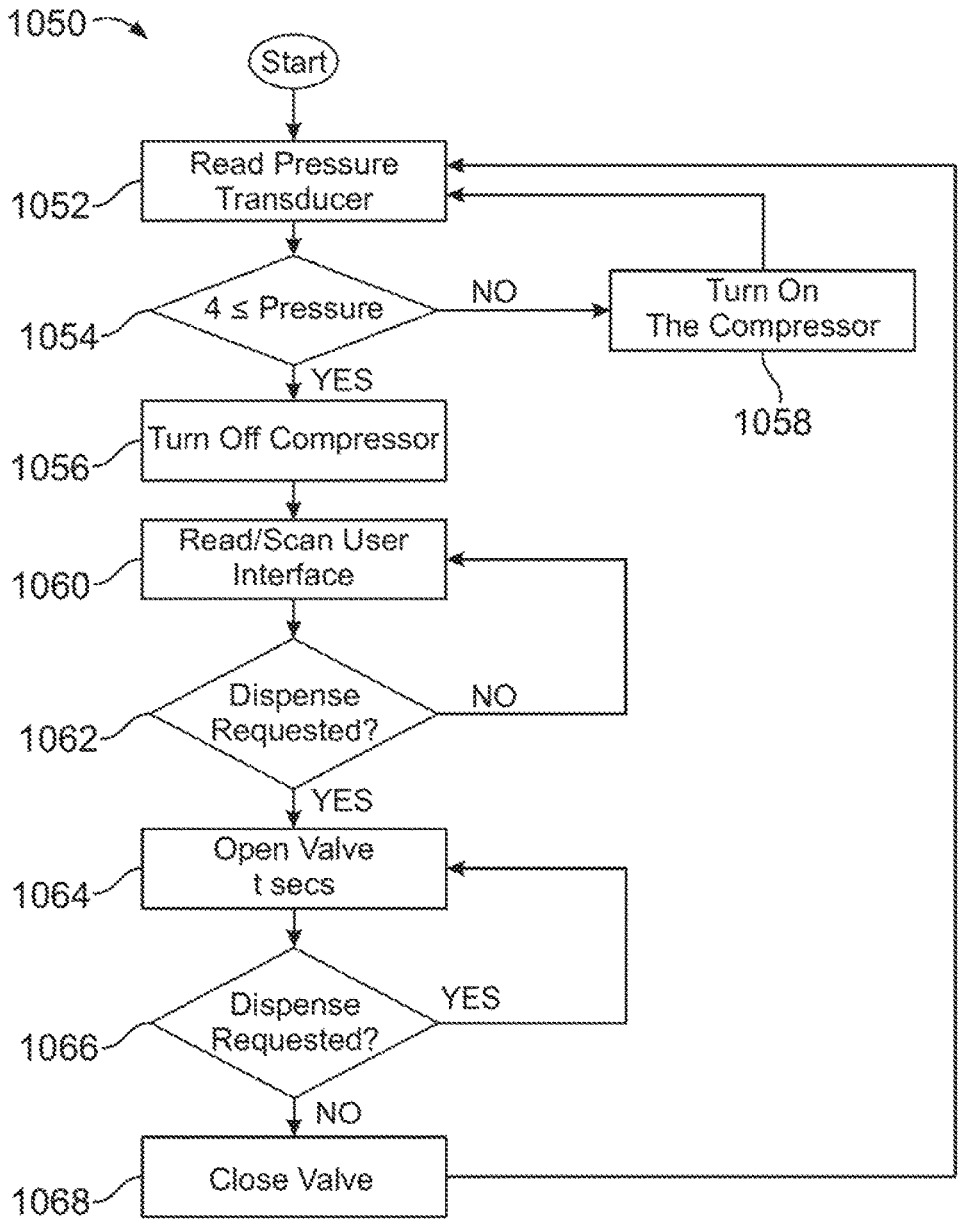
FIG. 10B depicts a method of dispensing viscous condiment using the alternate embodiment shown in FIG. 10A.

FIG. 10B depicts steps of a method 1050 for dispensing fixed amounts of a viscous condiment on each actuation of the single push button switch 1002 or continuously dispensing condiment. A first step 1052, the pressure transducer is read to determine if the pressure inside the vessel 104 is within predetermined pressure limits, typically above or equal to four pounds per square inch but less than about six pounds per square inch. If that pressure is determined to be correct as shown in step 1054, a previously-energized compressor is turned off at step 1056. If the pressure in the vessel is too low, the compressor is turned on at step 1058.

At step 1060, the switch is "scanned" or tested to determine if it is depressed or actuated. If the push button is determined to be depressed as shown in 1062, the valve is opened at 1064 for a predetermined length of time, the length of which is a design choice.

At step 1066, a decision is made when the predetermined time interval has elapsed. If it has, the valve is closed at step 1068 and the method returns to step 1052 where the pressure transducer is read again. If the pressure inside the vessel is not within the predetermined pressure range, the compressor is turned on again at step 1058 until the pressure transducer is satisfied.

Figure 11:
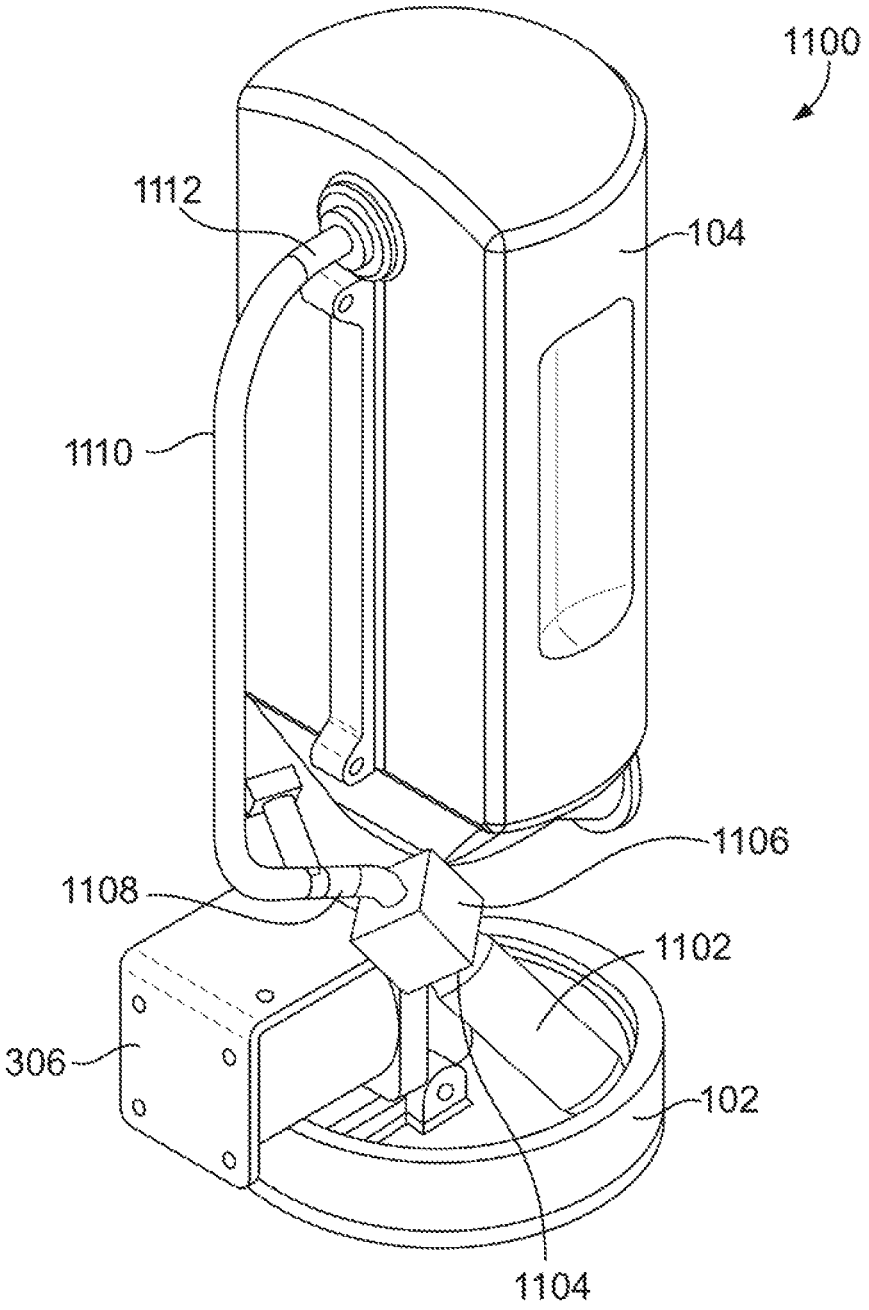
FIG. 11 is a perspective view of a pressurized viscous condiment dispenser showing an alternate embodiment of a source of pressurized gas.

FIG. 11 is a perspective view of another embodiment of the pressurized viscous condiment dispenser 1100. In this embodiment, the air pump 302 is replaced with a pressurized gas cylinder 1102, which is made of metal. The pressurized cylinder 1102 has a discharge port 1104 at the top of which is a pressure regulator 1106. The pressure regulator receives high-pressure gas from the cylinder 1102 and an input and provides a relatively constant low pressure output at an output port 1108 of the pressure regulator 1106. The output pressure from the regulator 1106 is between about four and six pounds per square inch. The output gas is provided into a flexible tube 1110 that is routed into an inlet port 1112 of the pressurized vessel 104. Operation of the embodiment shown in FIG. 11 is otherwise the same as that described above with respect to the dispenser shown in FIG. 1A.

Figure 12:
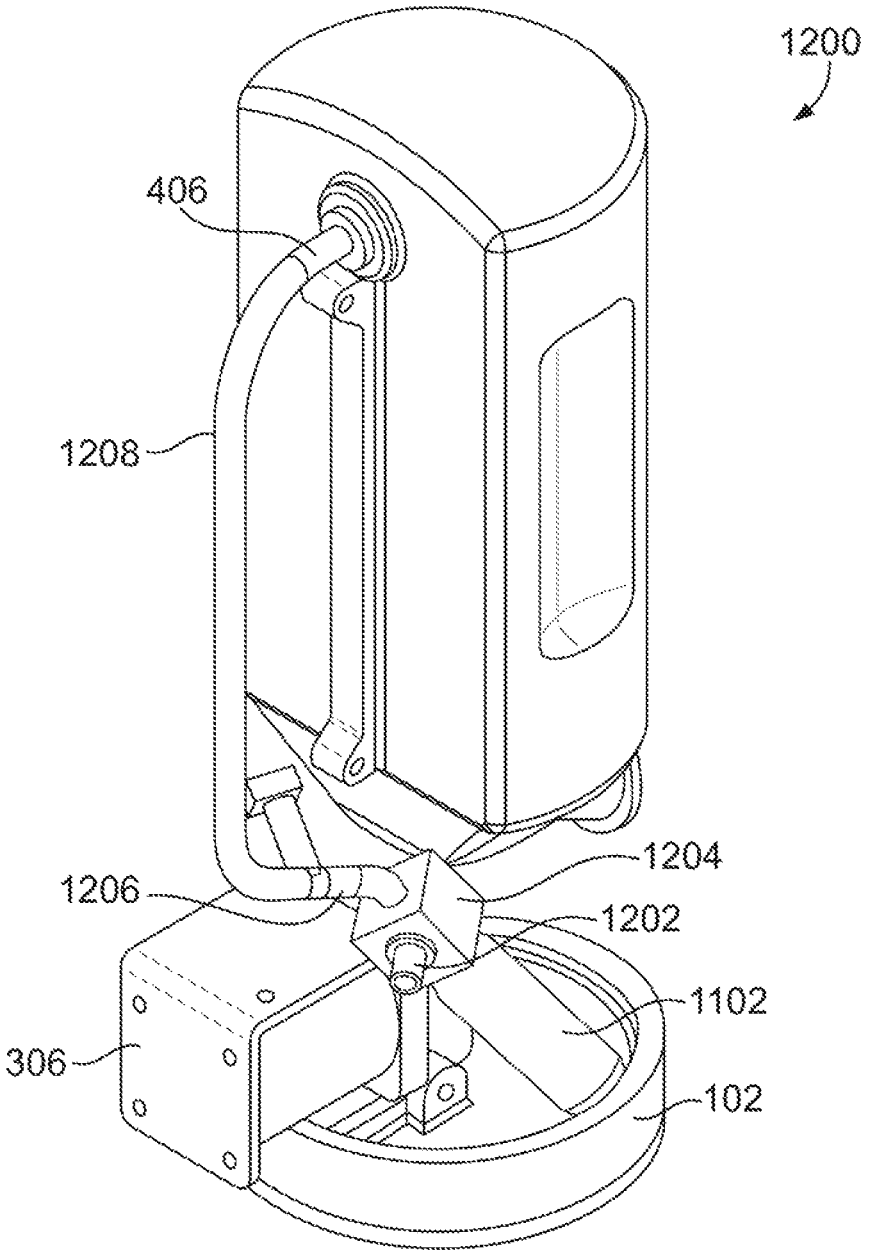
FIG. 12 is a perspective view of a pressurized viscous condiment dispenser showing another alternate embodiment of a source of pressurized gas.

FIG. 12 depicts yet another embodiment of a pressurized viscous condiment dispenser in which the pressurized gas bottle or canister 1102 is refilled through a hose barb 1202 that extends from a side of a pressure regulator 1204. A tube (not shown) is attached to the hose bard 1202, which extends to an external source of pressurized gas (not shown).

Compressed gas provided by an external source is used to re-fill the metal gas bottle or canister 1102, which is attached to a regulator 1204 with an output port 1206 attached to which is a flexible tube 1208 that provides a relatively fixed and constant pressure to the vessel 104. Operation of the embodiment shown in FIG. 12 is otherwise the same as that described above with respect to FIG. 11.

For purposes of claim construction, the compressor 302, the pressurized cylinder 1102 and the externally available gas pressure source connected into the gas bottle 1102 by a hose barb 1202 shown in FIGS. 11 and 12 are considered herein as gas sources, configured to pressurize the vessel 104. Those of skill in the art will recognize that the regulators 1106 and 1204 can themselves be gas sources inasmuch as they are coupled to the vessel 104 and are configured to pressurize the vessel 104 to facilitate dispensing a condiment therefrom. The regulators should therefore also be considered to be "gas sources."

In a preferred embodiment power to the processor and pinch valve is provided by a rechargeable battery. In an alternate embodiment power can be provided from a remote DC power supply connected to the dispenser via a short or long extension wire.

The foregoing description is for purposes of illustration only. The true scope of the invention is set forth in the following claims.

What is claimed is:

1. A pressurized viscous condiment dispenser comprising:

a user interface comprising at least one switch device and configured to receive a selection of an amount of condiment to be dispensed, and to provide, responsive to actuation of the switch device, an electrical signal which represents the amount of condiment to be dispensed;

a vessel, which is configured to be pressurized and to receive a condiment to be dispensed;

a gas source coupled to the vessel and configured to pressurize the vessel with a gas; and a valve coupled to the vessel and coupled to the user interface, the valve being configured to release condiment from the vessel responsive to an actuation of the user interface;

a pressure transducer pneumatically coupled to the vessel, the pressure transducer configured to provide an electrical signal which represents a pressure of the gas in the vessel; and a processor coupled to the user interface, the valve, and the pressure transducer, the processor receives the electrical signal from the pressure transducer and the electrical signal from the user interface and is configured to cause the valve to open for different lengths of time to dispense the amount of condiment to be dispensed responsive to the electrical signals received from the user interface and the pressure transducer.

2. The pressurized viscous condiment dispenser of claim 1, further comprising a bag, which is inside the vessel and coupled to the valve.

3. The pressurized viscous condiment dispenser of claim 1, further comprising a flexible tube coupled to an output of the vessel and which passes through the valve, the flexible tube having a first end coupled to the vessel and a second end located below the valve from which condiment is dispensed responsive opening the valve.

4. The pressurized viscous condiment dispenser of claim 1, wherein the pressure transducer comprises a microelectromechanical system (MEMS) pressure transducer.

5. The pressurized viscous condiment dispenser of claim 1, wherein the gas source comprises an electric air pump.

6. The pressurized viscous condiment dispenser of claim 1, wherein the gas source comprises an externally located compressor.

7. The pressurized viscous condiment dispenser of claim 1, wherein the valve is a pinch valve.

8. The pressurized viscous condiment dispenser of claim 1, wherein the valve is a gate valve.

9. The pressurized viscous condiment dispenser of claim 1, further comprising a nozzle, from which condiment is dispensed.

10. The pressurized viscous condiment dispenser of claim 1, wherein the user interface comprises a touch screen, operatively coupled to the processor.

11. The pressurized viscous condiment dispenser of claim 1, wherein the gas source comprises a container of pressurized gas.

12. The pressurized viscous condiment dispenser of claim 11, wherein the gas source further comprises a pressure regulator.

13. The pressurized viscous condiment dispenser of claim 1, wherein the user interface comprises a plurality of switches, operatively coupled to the processor.

14. The pressurized viscous condiment dispenser of claim 13, wherein the processor is configured to dispense different volumes of condiment responsive to actuation of different switches.

15. The pressurized viscous condiment dispenser of claim 1, wherein the user interface is supported by and comprises a handle.

16. The pressurized viscous condiment dispenser of claim 15, wherein the handle encloses a battery.

17. A pressurized viscous condiment dispenser comprising:

a user interface, configured to receive a selection of an amount of condiment to be dispensed and configured to provide a corresponding output signal;

a vessel, configured to be pressurized and receive a condiment to be dispensed;

an electric air pump, coupled to the vessel and configured to pressurize the vessel;

a pressure transducer, configured to provide an electrical output signal, which represents a pressure applied to the pressure transducer;

a pinch valve coupled to the vessel and configured to release different volumes of condiment from the vessel responsive to a signal provided to the pinch valve; and a processor coupled to the pinch valve and user interface, the processor being coupled to a non-transitory memory device storing instructions which when executed cause the processor to:

open the pinch valve for different lengths of time responsive to signals received from the user interface.

18. The pressurized viscous condiment dispenser of claim 17, wherein the memory device stores additional instructions, which when executed cause the processor to:

turn the electric air pump on and off responsive to the pressure transducer's electrical output signal; and open the pinch valve for different lengths of time responsive to signals received from the user interface.

19. The pressurized viscous condiment dispenser of claim 17, wherein the user interface comprises a plurality of switches, operatively coupled to the processor.

20. The pressurized viscous condiment dispenser of claim 17, wherein the processor is additionally configured to open the pinch valve for different lengths of time further responsive to the electrical output signal of the pressure transducer.

21. A pressurized viscous condiment dispenser comprising:

a user interface, which is configured to receive a selection of an amount of condiment to be dispensed, the user interface comprises at least one switch device, configured to provide an electrical signal responsive to actuation of the switch device;

a vessel, which is configured to be pressurized and to receive a condiment to be dispensed;

a gas source coupled to the vessel and configured to pressurize the vessel, the gas source comprises an electric air pump that receives ambient air and pumps said ambient air into the vessel responsive to a signal provided to the electric air pump by the processor;

a valve coupled to the vessel and coupled to the user interface, the valve being configured to release condiment from the vessel responsive to an actuation of the user interface;

a processor coupled to the valve and user interface, the processor being configured to cause the valve to open responsive to an input signal received from the user interface; and a pressure transducer pneumatically coupled to the vessel and electrically coupled to the processor, the pressure transducer configured to provide an electrical signal to the processor, which represents a pressure applied to the pressure transducer;

wherein the processor is configured to open the valve for different lengths of time responsive to signals received from the user interface and received from the pressure transducer.

22. The pressurized viscous condiment dispenser of claim 21, wherein the processor provides a signal to the electric air pump responsive to a signal received by the processor from the pressure transducer.

23. The pressurized viscous condiment dispenser of claim 21, further comprising a non-transitory memory device coupled to the processor, the non-transitory memory device storing program instructions, which when executed cause the processor to:

obtain a first signal from the pressure transducer;

activate the electric air pump responsive to the signal received from the pressure transducer;

obtain a second signal from the user interface; and selectively open the valve for different lengths of time responsive to at least one of the first and second signals.

24. The pressurized viscous condiment dispenser of claim 21, wherein the user interface comprises a single switch, operatively coupled to the processor.

* * * * *